US007158027B1

(12) United States Patent
Warren

(10) Patent No.: US 7,158,027 B1
(45) Date of Patent: Jan. 2, 2007

(54) EMERGENCY INTERRUPT SYSTEM

(76) Inventor: Eugene Warren, 3801 Stokes Dr., Baltimore, MD (US) 21229

( * ) Notice: Subject to any disclaimer, the term of this patent is extended or adjusted under 35 U.S.C. 154(b) by 138 days.

(21) Appl. No.: 11/074,393

(22) Filed: Mar. 7, 2005

(51) Int. Cl.
*G08B 1/08* (2006.01)

(52) U.S. Cl. ..... 340/539.1; 340/601; 702/3

(58) Field of Classification Search ..... 340/539.1, 340/531, 601, 506, 825.69; 702/3; 379/48
See application file for complete search history.

(56) References Cited

U.S. PATENT DOCUMENTS 5,276,909 A * 1/1994 Milner et al. ..... 340/7.49
6,204,761 B1 3/2001 Vanderable ..... 340/539
6,278,375 B1 8/2001 Hucker ..... 340/601
6,509,833 B1 1/2003 Tate ..... 340/539
2002/0097161 A1* 7/2002 Deeds ..... 340/601
2003/0193394 A1* 10/2003 Lamb ..... 340/539.28
2004/0183687 A1* 9/2004 Petite et al. ..... 340/601
2005/0237183 A1* 10/2005 Lamb ..... 340/539.11

* cited by examiner

*Primary Examiner*—Phung T. Nguyen
(74) *Attorney, Agent, or Firm*—Goldstein Law Offices, P.C.

(57) ABSTRACT

An emergency interrupt system, for supplying emergency information to a person while using an electronic device, and monitoring the electronic device with a monitor device. The emergency interrupt system is connected between the electronic device and monitor device, and obtains an audible visual signal from the electronic device. The emergency interrupt system receives an emergency radio signal, decodes audio and visual emergency information therefrom, and composites said information with the audible visual signal. The user then monitors the composited information with the monitor device.

4 Claims, 1 Drawing Sheet

EMERGENCY INTERRUPT SYSTEM

BACKGROUND OF THE INVENTION

The invention relates to an emergency interrupt system. More particularly, the invention relates to device that provides crucial news and instructions in the event of an emergency, to a person who is using a variety of electronic devices.

Mitigating the devastation and loss of life during an emergency situation requires notifying masses of people that may be effected by that disaster. To this end, air raid sirens were installed in public schools and other buildings around the country during the cold war, to warn people of an imminent attack.

Later, the Emergency Broadcast System was developed to keep the public involved in the event of an emergency. In particular, in the event of an emergency the Emergency Broadcast System interrupts radio and television broadcasts with an attention signal, followed by official news and instructions. The Emergency Broadcast System can thus be very effective in disseminating information to all people presently tuned in to a radio or television broadcast. Unfortunately, if a person is not watching a television broadcast or listening to the radio, and is instead watching a movie on VHS or DVD, or listening to a CD, that person cannot be notified, warned, or informed using the Emergency Broadcast System.

In addition, the provide warnings of severe weather situations, the National Weather Service and National Oceanographic and Atmospheric Administration provides a 24-hour national network or radio stations broadcasting continuous weather information directly from the offices of the National Weather Services.

The National Weather Service generates tone alert signals on their network, which can be used to trigger various devices, known as tone alert receivers. In particular, these devices remain seemingly "off", yet continually monitor the broadcast for a specific 1050 Hz alert tone. Upon detection of such a tone, they activate an audible and/or visual alarm, to notify the user of the broadcast.

Beyond simply providing weather reports, the National Weather Service will provide emergency warnings for all types of hazards, including such things as earthquakes, volcanoes, severe weather, and nuclear war.

In recent years the range of possibilities for disastrous situations has increased. Now that terrorist attacks have become a real possibility in this country, it is extremely important that the lines of communication with the public at large be expanded within all possible technological means.

U.S. Pat. No. 6,204,761 to Vanderable discloses a weather alert system. Vanderable warns a user when an emergency signal has been broadcast and simultaneously activates a television or other visual information source. Vanderable, however, only seems to work with a television that is not occupied with viewing another video source.

U.S. Pat. No. 6,509,833 to Tate discloses a method and system for providing a warning alert. Tate operates from within the telephone company switch, to alert subscribers by generating distinctive ring tones. Tate seems to rely, however, on the existence of telephone system lines. In the event of many emergency situations, however, the telephone lines might be damaged or otherwise unusable.

U.S. Pat. No. 6,278,375 to Hucker discloses a severe storm warning device. Hucker, however, is a self-contained device that is not intended to work with other electronic devices.

While these units may be suitable for the particular purpose employed, or for general use, they would not be as suitable for the purposes of the present invention as disclosed hereafter.

SUMMARY OF THE INVENTION

It is an object of the invention to produce a device for notifying the public about emergency situations. Accordingly, the present invention allows members of the public to be notified while using a wide variety of electronic devices.

It is another object of the invention to provide a device that provides visual and audible information. Accordingly the present invention is configured to work with an existing audio and/or visual monitoring device to present the information in a manner that it is readily and thoroughly received by the public at large.

It is a further object of the invention to provide a device that works with a wide variety of electronic devices. Accordingly, the present invention may be configured to work with CD players, Cassette Players, DVDs, VCRs, PCs, telephones, and more.

The invention is an emergency interrupt system, for supplying emergency information to a person while using an electronic device, and monitoring the electronic device with a monitor device. The emergency interrupt system is connected between the electronic device and monitor device, and obtains an audible visual signal from the electronic device. The emergency interrupt system receives an emergency radio signal, decodes audio and visual emergency information therefrom, and composites said information with the audible visual signal. The user then monitors the composited information with the monitor device.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
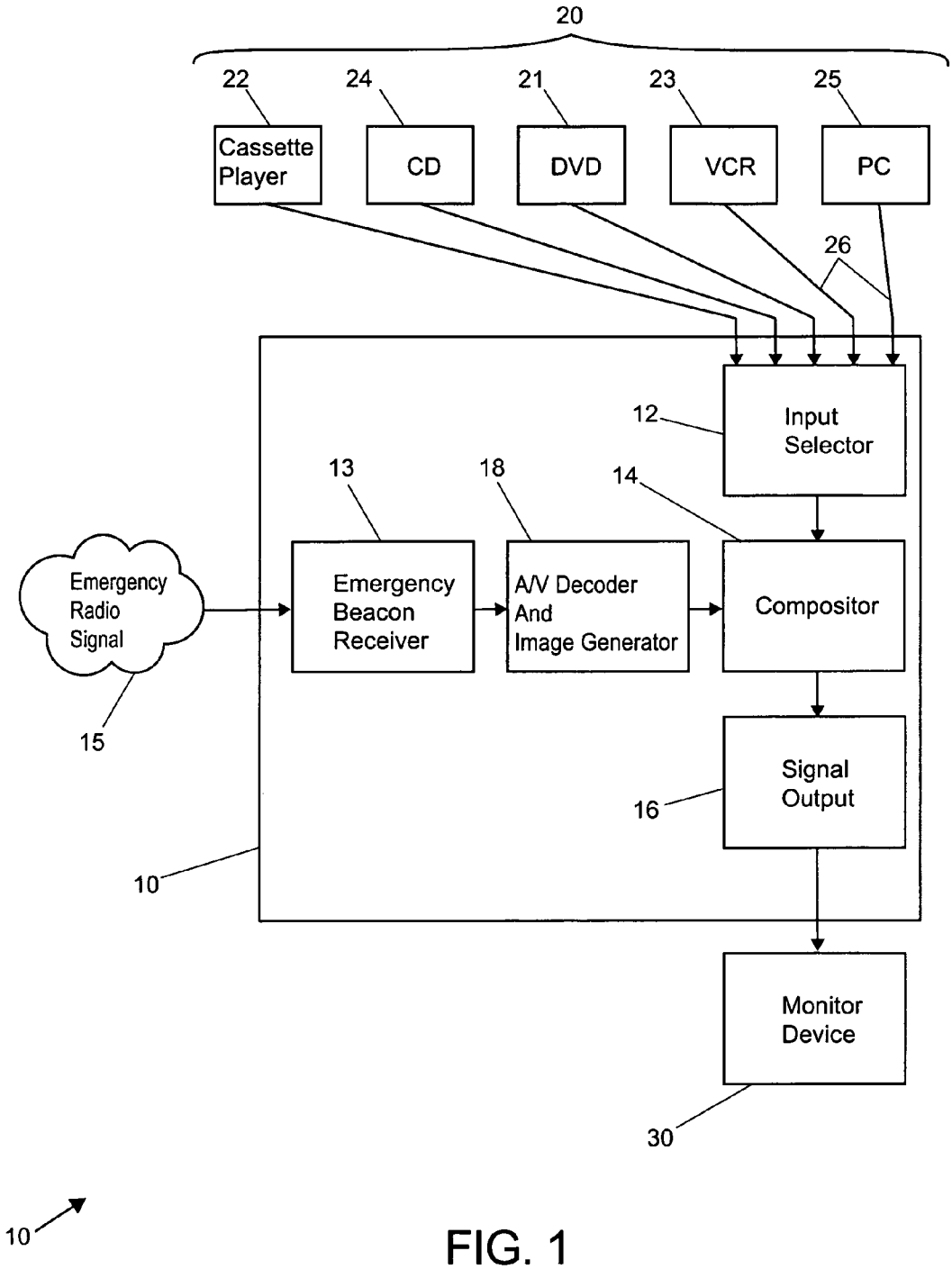
FIG. 1 is a block diagram, illustrating the interconnection of electronic devices to an audio/visual monitoring device using the present invention.

FIG. 1 is a block diagram, illustrating an emergency interrupt system 10. The emergency interrupt system works with an electronic device 20, including in the example shown, a DVD player 21, a cassette player 22, a VCR 23, a CD player 24, a Personal Computer CPU 25, and the like. Essentially, the electronic device 20 used with the present invention must produce an audible visual signal 26. Note that the audible visual signal 26 can include audible and/or visual content. More particularly, the audible visual signal 26 can contain an audio portion and a video portion.

The emergency interrupt system 10 obtains the audible visual signal 26 at an input selector 12. The input selector 12 allows numerous electronic devices 20 to be connected to the emergency interrupt system, and allows the user to select between which of these electronic devices 20 is currently active. The audible visual signal 26 selected by the input selector 12 then passes through a compositor 14. The resulting signal produced by the compositor is provided at the signal output 16.

A monitor device 30 is connected to the signal output 16. The monitor device 30 is any device capable of reproducing visual images and/or audible programs from a given input signal. Accordingly, the monitor device 30 may be a television with or without built-in speakers, a computer monitor with or without built-in speakers, a video monitor and with sound amplification system, an audio amplifier and speakers, etc. According to an embodiment of the invention, the monitor device 30 may even be a telephone handset.

According to the present invention then, the emergency interrupt system 10 is connected between an electronic device 20 and the monitor device 30. The audible visual signal 26 ordinarily passes through the emergency interrupt system 10 substantially unchanged. In the event of an emergency, however, the emergency audio signal is mixed with the audio portion of the audible visual signal 26 by the compositor 14, and visual emergency information is mixed with the video portion of the audible visual signal 26 by the compositor 14.

In order to facilitate interruption of the audible and visual signal 26 in the event of an emergency, the emergency interrupt system 10 includes an emergency beacon receiver 16 capable of receiving an emergency radio signal 15. The emergency radio signal 15 might be any emergency signal currently or prospectively transmitted on a mass basis, containing encoded audible and visual information. The emergency beacon receiver 13 detects the emergency signal 15, which is decoded by an A/V decoder and image generator 18, which supplies audio and video signals created from the emergency radio signal 15 to the compositor 14. The compositor 14 combines the audible and visual information from the emergency signal 15 with the audible visual signal 16 and supplies the resultant signal to the signal output 16.

The emergency radio signal 15 preferably includes information about natural disasters, terrorist attacks, industrial accidents, etc. In addition, it is preferred that the emergency radio signal 15 provide information about child abductions, as currently reported using the "Amber Alert" system. Providing such information to all users of the emergency interrupt system 10 can be extremely helpful toward returning abducted and missing children home safely.

Accordingly, when the user is listening to a CD or cassette from the CD player, watching a movie from the DVD player or VCR, or using the PC CPU, and the user listens or watches the same using the monitor device 30, and an emergency situation occurs, the user will be notified audibly and/or visually through the monitor device 30. It should also be noted that other the emergency interrupt system 10 can be configured with various inputs and connector types to accommodate a wide variety of electronic devices 20 and monitor devices 30. For example, the system 10 can be configured for use with a telephone, wherein the telephone base may be connected to the input selector, and the handset connected to the signal output 16.

In conclusion, herein is presented an emergency interrupt system that notifies a user of electronic devices of an emergency situation. The invention is illustrated by example in the drawing figures, and throughout the written description. It should be understood that numerous variations are possible, while adhering to the inventive concept. Such variations are contemplated as being a part of the present invention.

What is claimed is:

1. An emergency interrupt system, for warning a person of an emergency situation while using an electronic device with a monitor device, the electronic device producing an audible visual signal including at least one of audible and visual information, for use with an emergency radio signal containing audible and visual information, comprising:

a emergency beacon receiver, for receiving the emergency radio signal;

an A/V decoder and image generator, for decoding audible and visual information from the emergency radio signal and producing an audio signal and video signal;

a compositor for combining the audio signal and video signal from the A/V decoder and image generator with the audible visual signal and generating a resultant signal; and a signal output for connecting to the monitor device and supplying the resultant signal from the compositor, for supplying audible and visual emergency information to the user while performing at least one of listening and watching the electronic device on the monitor device.

2. The emergency interrupt system as recited in claim 1, further comprising an input selector, for receiving audible visual signals from several electronic devices simultaneously, and supplying the audible visual signal from one of the electronic devices to the compositor.

3. An emergency interrupt method, for warning a person of an emergency situation while using an electronic device with a monitor device, the electronic device producing an audible visual signal including at least one of audible and visual information, for use with an emergency radio signal containing audible and visual emergency information, using an emergency interrupt device, comprising the step of:

connecting the emergency interrupt device between the electronic device and the monitor;

supplying an audible visual signal to the emergency interrupt device by the electronic device;

detecting audible and visual emergency information from the emergency radio signal by the emergency interrupt device;

producing an output signal by compositing the audible and visual emergency information with the audible visual signal from the electronic device by the emergency interrupt device; and monitoring the output signal by the user with the monitor device.

4. The emergency interrupt system as recited in claim 3, wherein the electronic device comprises a plurality of electronic devices; wherein the emergency interrupt device has an input selector; wherein the step of connecting the emergency interrupt device further comprises connecting the plurality of electronic devices to the input selector; and wherein the step of producing an output signal further comprises choosing the audible visual signal from one of the electronic devices by the input selector.

* * * * *